United States Patent [19]

Rudner

[11] 4,125,118

[45] Nov. 14, 1978

[54] SMOKING COMPOSITIONS

[75] Inventor: Bernard Rudner, Ridgewood, N.J.

[73] Assignee: Tenneco Chemicals, Inc., Saddle Brook, N.J.

[21] Appl. No.: 756,670

[22] Filed: Jan. 4, 1977

[51] Int. Cl.[2] ..... A24B 15/00

[52] U.S. Cl. ..... 131/9; 131/17 R; 131/140 R

[58] Field of Search ..... 131/2, 15, 17, 140 R, 131/8 R, 140 C, 9

[56] References Cited

U.S. PATENT DOCUMENTS

| | | | |
|---|---|---|---|
| 2,739,913 | 3/1956 | Lieser | 131/17 R |
| 2,914,072 | 11/1959 | Tyrer et al. | 131/17 R |
| 4,055,191 | 10/1977 | Norman et al. | 131/9 |

FOREIGN PATENT DOCUMENTS

| | | | |
|---|---|---|---|
| 841,074 | 7/1960 | United Kingdom | 131/17 R |

OTHER PUBLICATIONS

United States Published Patent Application B306,655, Date 1/28/1975.

*Primary Examiner*—Robert W. Michell
*Assistant Examiner*—V. Millin
*Attorney, Agent, or Firm*—Evelyn Berlow

[57] ABSTRACT

The amounts of tars, nicotine, phenols, carbon monoxide, hydrogen cyanide, and other toxic materials generated during the smoking of tobacco and its substitutes is reduced by incorporating in the smoking composition a small amount of a transition metal compound, e.g., chromium n-heptanoate.

19 Claims, No Drawings

SMOKING COMPOSITIONS

This invention relates to smoking compositions and to a process for their production. It further relates to smoking devices, such as cigarettes and cigars, made from these smoking compositions.

Smoke generated by the combustion of tobacco and tobacco substitutes in conventional smoking devices contains nicotine, phenols, tars, polycyclic aromatic hydrocarbons, carbon monoxide, hydrogen cyanide, aldehydes, and other materials that are known to be toxic to the smoker and to others who breathe the smoke.

Previous attempts to remove harmful substances from cigarette and cigar smoke have generally been unsuccessful. In some cases, the proposed method did not reduce the concentrations of these substances to the desired very low levels. In others, the method used to remove these materials from the smoke also removed the components that impart flavor and aroma to tobacco and tobacco smoke.

It has now been found that the amounts of nicotine, phenols, tars, polycyclic aromatic hydrocarbons, carbon monoxide, hydrogen cyanide, aldehydes, and other toxic materials in the smoke of tobacco and tobacco substitutes can be reduced substantially by incorporating a small amount of certain transition metal compounds in the smoking composition. In this way, a reduction in the amount of harmful substances in the smoke is achieved without adversely affecting the organoleptic properties of the smoking composition or its smoke.

The transition metal compounds that can be used to reduce the amounts of the aforementioned toxic materials in the smoke of tobacco and tobacco substitutes are those that are capable of promoting the oxidation of the toxic materials and in which the toxic materials are at least moderately soluble. They include transition metal salts of organic monocarboxylic acids having 4 to 24 carbon atoms, overbased transition metal salts of these monocarboxylic acids, amine complexes of transition metal salts of these monocarboxylic acids, and mixtures thereof. They are preferably compounds of transition metals that have atomic numbers of 21 to 29 inclusive and 39 to 47 inclusive, with best results being obtained when chromium, manganese, iron, cobalt, nickel, copper, or zirconium compounds or mixtures of these compounds are used. The acids from which these compounds are derived are organic monocarboxylic acids having from 4 to 24 carbon atoms. They preferably are straight-chain or branched-chain aliphatic monocarboxylic acids having 5 to 18 carbon atoms, cycloaliphatic acids having 5 to 20 carbon atoms, aromatic monocarboxylic acids having 7 to 18 carbon atoms, or mixtures of these acids. Illustrative of the preferred acids are n-hexanoic acid, n-heptanoic acid, n-octanoic acid, n-decanoic acid, n-tetradecanoic acid, n-octadecanoic acid, 2-ethylbutanoic acid, 2,2-dimethylpropanoic acid, 2,2-dimethylpentanoic acid, 2-ethyl-4-methylpentanoic acid, 2-ethylhexanoic acid, isononanoic acid, isodecanoic acid, 2-ethyldecanoic acid, 2-octyldecanoic acid, 2-ethyldodecanoic acid, hydroxystearic acid, levulinic acid, oleic acid, soybean oil fatty acids, castor oil fatty acids, tall oil acids, cyclopentanecarboxylic acid, methylcyclopentanecarboxylic acid, cyclohexanecarboxylic acid, 1,1-dimethylcyclohexanecarboxylic acid, benzoic acid, salicylic acid, tert.butylbenzoic acid, and the like. Particularly satisfactory results are obtained when an aliphatic or cycloaliphatic monocarboxylic acid having 5 to 10 carbon atoms, such as n-pentanoic acid, n-hexanoic acid, 2-ethylhexanoic acid, naphthenic acid, isononanoic acid, or neodecanoic acid, is used. A single transition metal compound or a mixture of two or more of these compounds may be incorporated in or applied to the combustible material.

The amount of transition metal compound that is added to the combustible material is that which will provide from 0.0005% to 5% by weight of the transition metal, based on the weight of the smoking composition. It is usually preferred that the composition contain from 0.001% to 4% by weight of the transition metal.

The combustible material that is treated with a transition metal compound to form the smoking compositions of this invention may be tobacco, reconstituted tobacco, tobacco waste products such as stalks, ribs and fragments, a tobacco substitute, or a mixture of these materials. Among the tobacco substitutes that can be used are wood pulp, cellulose, and cellulose derivatives including methylcellulose, hydroxyethylcellulose, and carboxymethylcellulose. Also useful are the polymer-like lower molecular weight fragments of cellulose that are obtained by thermal degradation of cellulose and the products resulting from the oxidation of cellulose under acid or alkaline conditions. Particularly advantageous results are obtained when the smoking composition contains tobacco, reconstituted tobacco, tobacco waste products, cellulose, oxidized cellulose, or a mixture of these materials.

The transition metal compound may be incorporated into the smoking compositions in a variety of ways. For example, it may be mixed with the tobacco or other combustible material until a uniform blend is obtained, or it may be combined with one or more of the conventional additives such as fillers, humectants, binding agents, and flavorants, that are used to impart desired physical properties and burning characteristics and the resulting mixture applied to or incorporated into the smoking composition. In a preferred embodiment of the invention, a solution of one or more of the transition metal compounds in an inert, non-polar organic solvent such as hexane, heptane, octane, mineral spirits, benzene, xylene, chlorobenzene, or carbon tetrachloride, is applied to the combustible material by spraying, soaking, sprinkling, or the like after which the solvent is driven off as a vapor leaving the compound thoroughly incorporated in the combustible material. Alternatively, a solution of a metal salt may be applied to the paper or tobacco in which the combustible material is wrapped. In addition to the transition metal salt of an organic monocarboxylic acid, the solution with with the combustible material is treated may contain such other components as dispersants, organic monocarboxylic acids, amines such as ethylene diamine, trimethylene diamine and tetramethylene diamine which are capable of forming complexes with the metal salt, or the oxide, hydroxide, or carbonate of the transition metal. The addition of the transition metal compound to the combustible material may take place at any time prior to the final packaging of the smoking composition.

The smoking compositions of this invention may be further processed and formed into any desired shape or form, e.g., cigarettes, cigars, or pipe tobacco, by techniques that are well known to those skilled in the tobacco art.

The invention is further illustrated by the following examples.

EXAMPLE 1

One hundred gram portions of standardized research cigarette tobacco, obtainable from the Tobacco Health Research Institute, University of Kentucky, Lexington, Kentucky, were tumbled with solutions of metal compounds in such amounts as to distribute 3% by weight of the metal, based on the weight of tobacco, uniformly throughout the tobacco. The solutions contained either one or more transition metal salts of a monocarboxylic acid, an amine complex of a transition metal salt, or another metal salt in exempt mineral spirits that had a distillation range of 160° to 190° C. The following solutions were used:

(a) Solution containing 34.1% by weight of zirconium 2-ethylhexanoate and 9.5% by weight of 2-ethylhexanoic acid (b) Solution containing 30.2% by weight of cobalt naphthenate, 5.5% by weight of cobalt 2-ethylhexanoate, and 3.2% by weight of a dispersant (c) Solution containing 35% by weight of cobalt naphthenate and 27.5% by weight of cobalt hydroxide (d) Solution containing 69.6% by weight of manganous neodecanoate (e) Solution containing 39.7% by weight of ferrous isononanoate (f) Solution containing 20% by weight of a cuprous decanoateethylene diamine complex (g) A comparative solution containing 40% by weight of plumbous tallate and 2.6% dispersant (h) A comparative solution containing 10% by weight of calcium stearate.

The treated tobacco was dried, conditioned, and converted to cigarettes that meet the FTC specifications for standard research filter cigarettes.

EXAMPLE 2

The cigarettes whose preparation is described in Example 1 were smoked in a smoking machine using the FTC protocol for testing. In the tests, five cigarettes containing tobacco that had been treated with one of the solutions described in Example 1 were consecutively smoked in each of two ports of a 20-port Phipps and Bird smoking machine. The test cigarettes were smoked with a puff volume of 35 ml., a puff time of 2 seconds, and a puff frequency of 60 seconds. The condensate formed was deposited on a Cambridge filter and weighed. The water content, total particulate matter, organic bases as nicotine, and tar, which is total particulate material minus moisture and organic bases, were determined by standard methods. The results obtained for each of the five parts of identically-treated cigarettes were averaged. The results obtained are set forth in Table I. Also included in this table are the results obtained using simultaneously made and conditioned cigarettes in which the tobacco was not treated with a metal salt or in which the tobacco was treated with other metal salts.

Table I

| Tobacco Composition | Metal Incorporated into the Tobacco | % Increase (+) or Decrease (−) as Compared to Control Composition (i) in | |
|---|---|---|---|
| | | Tar | Total Organic Bases |
| a | Zirconium | − 8 | −16 |
| b | Cobalt | −32 | −12 |
| c | Cobalt | −46 | −19 |
| d | Manganese | −28 | − 7 |
| e | Iron | −21 | −11 |
| f | Copper | −28 | − 1 |
| Comparative Examples | | | |
| g | Lead | − 1 | + 3 |
| h | Calcium | − 2 | + 8 |
| i (Control) | None | 0 | 0 |

From the data in Table I, it will be seen that the transition metal compounds were far more effective in inhibiting the generation of toxic materials than the non-transition metal salts.

EXAMPLE 3

Cigarettes that contained 3% of transitional metals, based on the weight of the tobacco, were prepared and conditioned by the procedure described in Example 1 using the following solutions of metal salts in mineral spirits that had a distillation range of 160° to 190° C.:

(j) Solution containing 34.1% by weight of zirconium 2-ethylhexanoate and 9.5% by weight of 2-ethylhexanoic acid (k) Solution containing 30.2% by weight of cobalt naphthenate, 5.5% by weight of cobalt 2-ethylhexanoate, and 3.2% by weight of a dispersant (l) Solution containing 35% by weight of cobalt naphthenate and 27.5% by weight of cobalt hydroxide (m) Solution containing 69.6% by weight of manganese neodecanoate (n) Solution containing 39.7% by weight of ferrous isononanoate (o) Solution containing 20% by weight of a cuprous decanoate-ethylene diamine complex (p) Solution containing 29.6% by weight of chromium n-heptanoate and 32.4% by weight of chromium n-octanoate (q) Solution containing 10% by weight of nickel 2-ethylhexanoate.

Cigarettes containing tobacco that had been treated with Solutions j–q were smoked in a Phipps and Bird smoking machine which had been fitted at the exhaust end of each port, just downstream of the Cambridge filter, with a gas collecting apparatus capable of permitting gas chromatographic analysis of representative samples of the smoke. For comparative purposes, cigarettes in which the tobacco had not been treated with one of these solutions were included in the test. The results obtained are set forth in Table II.

Table II

| Tobacco Composition | Metal Incorporated into the Tobacco | % Increase (+) or Decrease (−) as Compared to Control Composition (r) in | | |
|---|---|---|---|---|
| | | CO | HCN | $CH_2O$ |
| j | Zirconium | − 9 | −19 | − 7 |
| k | Cobalt | −22 | −28 | −43 |
| l | Cobalt | −26 | −21 | −45 |
| m | Manganese | −43 | −33 | −51 |
| n | Iron | −41 | − 1 | −33 |
| o | Copper | − 6 | −13 | −24 |
| p | Chromium | −18 | −17 | −36 |
| q | Nickel | −25 | − 9 | −22 |

Table II-continued

| Tobacco Composition | Metal Incorporated into the Tobacco | % Increase (+) or Decrease (−) as Compared to Control Composition (r) in | | |
|---|---|---|---|---|
| | | CO | HCN | $CH_2O$ |
| r (Control) | None | 0 | 0 | 0 |

From the data in Table II, it will be seen that all of the transition metals tested were effective in reducing the amounts of carbon monoxide, hydrogen cyanide, and formaldehyde in the cigarette smoke.

Each of the other transition metals disclosed herein can be used in a similar manner to reduce the levels of carbon monoxide, hydrogen cyanide, nicotine, phenols, and/or polycyclic hydrocarbons in tobacco smoke.

What is claimed is:

1. A smoking composition that comprises a combustible material and at least one transition metal compound selected from the group consisting of transition metal salts of monofunctional organic monocarboxylic acids having 4 to 24 carbon atoms, overbased transition metal salts of said acids, amine complexes of said transition metal salts, and mixtures thereof, said transition metal being selected from the group consisting of chromium, manganese, iron, cobalt, nickel, copper, zirconium, and mixtures thereof.

2. A smoking composition as defined in claim 1 that contains an amount of the transition metal compound that provides from 0.0005% to 5% by weight of transition metal, based on the weight of the smoking composition.

3. A smoking composition as defined in claim 1 that contains an amount of the transition metal compound that provides from 0.001% to 4% by weight of transition metal, based on the weight of the smoking composition.

4. A smoking composition as defined in claim 1 that comprises a combustible material and a cobalt compound.

5. A smoking composition as defined in claim 1 that comprises a combustible material an an iron compound.

6. A smoking composition as defined in claim 1 that comprises a combustible material and a manganese compound.

7. A smoking composition as defined in claim 1 that comprises a combustible material and a copper compound.

8. A smoking composition as defined in claim 1 that comprises a combustible material and a chromium compound.

9. A smoking composition as defined in claim 1 wherein the transition metal compound is a salt of an organic acid selected from the group consisting of aliphatic monocarboxylic acids having 5 to 18 carbon atoms, cycloaliphatic monocarboxylic acids having 5 to 20 carbon atoms, aromatic monocarboxylic acids having 7 to 18 carbon atoms, and mixtures thereof.

10. A smoking composition as defined in claim 1 wherein the transition metal compound is a salt of an aliphatic monocarboxylic acid having 5 to 10 carbon atoms.

11. A smoking composition as defined in claim 1 wherein the transition metal compound is a salt of a cycloaliphatic monocarboxylic acid having 5 to 10 carbon atoms.

12. A smoking composition as defined in claim 1 wherein the combustible material is selected from the group consisting of tobacco, reconstituted tobacco, tobacco waste products, wood pulp, cellulose, methylcellulose, hydroxyethylcellulose, carboxymethylcellulose, oxidized cellulose degraded cellulose, and mixtures thereof.

13. A cigarette comprising the smoking composition of claim 1.

14. A cigar comprising the smoking composition of claim 1.

15. A pipe tobacco comprising the smoking composition of claim 1.

16. The process for the production of a smoking composition that comprises adding to a combustible material from 0.0005% to 5% by weight, based on the weight of the smoking composition, of at least one transition metal, said transition metal being added as a transition metal compound selected from the group consisting of transition metal salts of monofunctional organic monocarboxylic acids having 4 to 24 carbon atoms, overbased transition metal salts of said acids, amine complexes of said transition metal salts, and mixtures thereof, said transition metals being selected from the group consisting of chromium, manganese, iron, cobalt, nickel, copper, zirconium, and mixtures thereof.

17. The process of claim 16 wherein the transition metal compound is a salt of an aliphatic monocarboxylic acid having 5 to 18 carbon atoms.

18. The process of claim 16 wherein a solution of a transition metal compound in an inert non-polar organic solvent is added to the combustible material, and the resulting transition metal-containing combustible material is dried to remove the solvent.

19. The process of claim 16 wherein the combustible material is selected from the group consisting of tobacco, reconstituted tobacco, tobacco waste products, wood pulp, cellulose, methylcellulose, hydroxyethylcellulose, carboxymethylcellulose, oxidized cellulose, degraded cellulose, and mixtures thereof.

* * * * *